US008322597B2

(12) United States Patent
Purcell et al.

(10) Patent No.: US 8,322,597 B2
(45) **Date of Patent: *Dec. 4, 2012**

(54) INSERT AND ENVELOPE ASSEMBLY

(75) Inventors: Douglas K. Purcell, Chicopee, MA (US); Karl C. Unger, Westfield, MA (US); Brian K. Dudley, Wilbraham, MA (US)

(73) Assignee: Envelope Product Group, LLC, Stamford, CT (US)

( * ) Notice: Subject to any disclaimer, the term of this patent is extended or adjusted under 35 U.S.C. 154(b) by 1389 days.

This patent is subject to a terminal disclaimer.

(21) Appl. No.: 11/373,558

(22) Filed: Mar. 10, 2006

(65) Prior Publication Data

US 2006/0202008 A1 Sep. 14, 2006

Related U.S. Application Data

(60) Provisional application No. 60/660,643, filed on Mar. 11, 2005.

(51) Int. Cl.
*B65D 27/10* (2006.01)

(52) U.S. Cl. ..... 229/70; 229/69; 229/300; 229/74

(58) Field of Classification Search ..... 229/70, 229/75, 69, 300, 74

See application file for complete search history.

(56) References Cited

U.S. PATENT DOCUMENTS

| | | | | | |
|---|---|---|---|---|---|
| 295,598 | A | * | 3/1884 | Trum | 229/76 |
| 311,915 | A | * | 2/1885 | Pedrick | 229/92.7 |
| 691,767 | A | | 1/1902 | Herndon | |
| 759,382 | A | | 5/1904 | Klugh | |
| 893,202 | A | * | 7/1908 | Shaw | 462/65 |
| 902,648 | A | * | 11/1908 | Drinkwater | 229/76 |
| 1,875,804 | A | * | 9/1932 | Dicicco | 229/68.1 |
| 1,944,980 | A | | 1/1934 | Hayes | |
| 2,417,050 | A | | 3/1947 | Baluk | |
| 2,442,646 | A | * | 6/1948 | Fields | 222/213 |
| 2,497,064 | A | * | 2/1950 | Baynes | 206/215 |
| 2,877,944 | A | | 3/1959 | Hyman | |
| 2,931,559 | A | | 4/1960 | Hilliard | |
| 2,964,233 | A | * | 12/1960 | McFarland | 229/302 |

(Continued)

FOREIGN PATENT DOCUMENTS

EP 1246095 10/2002

(Continued)

OTHER PUBLICATIONS

"A Product Data File . . . Bulletin—Pre-Inserted Envelopes" by Tension Envelope Corporation (Mar. 1984).

(Continued)

*Primary Examiner* — Nathan J Newhouse
*Assistant Examiner* — Peter Helvey
(74) *Attorney, Agent, or Firm* — St. Onge Steward Johnston & Reens LLC

(57) ABSTRACT

An insert and envelope assembly including a first envelope having a flap portion and a body portion having an inner cavity. The flap portion is directly attachable to the body portion to generally seal the inner cavity. The assembly further includes an insert located externally of the inner cavity and coupled to the first envelope. The insert is positioned to at least partially block access the inner cavity, and the insert is located and positioned such the insert must be handled or moved in order to fully access the inner cavity. The assembly further includes a second envelope receiving therein the first envelope along with the located and positioned insert.

23 Claims, 5 Drawing Sheets

U.S. PATENT DOCUMENTS

| | | | | | |
|---|---|---|---|---|---|
| 3,083,904 | A | * | 4/1963 | Brenner et al. | 360/131 |
| 3,139,230 | A | * | 6/1964 | Knittel | 229/76 |
| 3,141,603 | A | * | 7/1964 | Whitman | 229/70 |
| 3,237,327 | A | * | 3/1966 | Griggs | 40/643 |
| 3,334,806 | A | | 8/1967 | Hiersteiner | |
| 3,349,226 | A | * | 10/1967 | Goldstern | 235/489 |
| 3,356,285 | A | | 12/1967 | Greason | |
| 3,460,743 | A | * | 8/1969 | Burnett | 229/70 |
| 3,472,444 | A | * | 10/1969 | Herndon et al. | 229/70 |
| 3,489,332 | A | * | 1/1970 | Knittel | 229/80 |
| 3,568,398 | A | | 3/1971 | Allison et al. | |
| 3,652,007 | A | | 3/1972 | MacDougall | |
| 3,701,468 | A | | 10/1972 | Steinhauser | |
| 3,791,572 | A | * | 2/1974 | Gendron | 229/69 |
| 3,813,028 | A | | 5/1974 | Greason | |
| 3,820,447 | A | | 6/1974 | Gendron et al. | |
| 3,863,835 | A | | 2/1975 | Gendron | |
| 3,908,892 | A | * | 9/1975 | Pelzer | 229/305 |
| 3,946,938 | A | * | 3/1976 | Kranz | 229/305 |
| 3,949,935 | A | * | 4/1976 | Stackig | 229/68.1 |
| 3,958,690 | A | * | 5/1976 | Gee, Sr. | 206/232 |
| 3,968,927 | A | | 7/1976 | Katz et al. | |
| 3,986,662 | A | | 10/1976 | Luftig | |
| 4,011,985 | A | | 3/1977 | Simson | |
| 4,047,661 | A | * | 9/1977 | Klein | 229/70 |
| 4,579,277 | A | * | 4/1986 | Gendron | 229/74 |
| 4,762,271 | A | | 8/1988 | Lewyt | |
| 4,781,322 | A | * | 11/1988 | Humm | 229/303 |
| 4,801,076 | A | | 1/1989 | Schoenleber et al. | |
| 4,915,287 | A | | 4/1990 | Volk et al. | |
| 5,064,115 | A | | 11/1991 | Steidinger | |
| 5,071,061 | A | | 12/1991 | Willis | |
| 5,169,060 | A | * | 12/1992 | Tighe et al. | 229/301 |
| 5,280,961 | A | * | 1/1994 | Rohloff | 283/2 |
| 5,366,145 | A | * | 11/1994 | Sauerwine | 229/304 |
| 5,380,046 | A | * | 1/1995 | Stephens | 283/75 |
| 5,415,341 | A | * | 5/1995 | Diamond | 229/80 |
| 5,425,500 | A | * | 6/1995 | Sauerwine | 229/303 |
| 5,467,917 | A | * | 11/1995 | Potter | 229/301 |
| 5,505,376 | A | * | 4/1996 | Kent et al. | 229/311 |
| 5,507,525 | A | * | 4/1996 | Leuenberger | 283/67 |
| 5,573,277 | A | * | 11/1996 | Petkovsek | 283/79 |
| 5,687,904 | A | * | 11/1997 | Potter | 229/303 |
| 5,755,375 | A | | 5/1998 | Rogers | |
| 5,779,137 | A | | 7/1998 | Coffey | |
| 5,813,596 | A | * | 9/1998 | Dahlquist | 229/92.8 |
| 5,836,453 | A | * | 11/1998 | Herrera | 206/702 |
| 5,913,472 | A | * | 6/1999 | Dahlquist | 229/80 |
| 5,967,403 | A | | 10/1999 | Kranz | |
| 6,024,278 | A | | 2/2000 | Martin | |
| 6,062,465 | A | * | 5/2000 | Kearns | 229/70 |
| 6,089,613 | A | * | 7/2000 | Petkovsek | 283/79 |
| 6,116,655 | A | * | 9/2000 | Thouin et al. | 283/107 |
| 6,196,447 | B1 | | 3/2001 | Purcell et al. | |
| 6,371,521 | B1 | * | 4/2002 | Petkovsek | 283/67 |
| 6,402,015 | B1 | * | 6/2002 | Collins | 229/74 |
| 6,406,586 | B1 | * | 6/2002 | Rodriguez | 156/289 |
| 6,446,374 | B1 | * | 9/2002 | Ardiff | 40/593 |
| 6,460,760 | B1 | * | 10/2002 | Sass | 229/305 |
| 6,684,980 | B2 | | 2/2004 | Hungerford, III | |
| 6,691,913 | B1 | * | 2/2004 | Rodriguez | 229/246 |
| 7,127,844 | B2 | * | 10/2006 | Collins | 40/124.16 |
| 7,334,719 | B1 | * | 2/2008 | Fisher | 229/80.5 |
| 7,350,687 | B2 | * | 4/2008 | Sanchez et al. | 229/80 |
| 2002/0138335 | A1 | | 9/2002 | Palmer et al. | |
| 2003/0059751 | A1 | * | 3/2003 | Welles | 434/238 |
| 2004/0069661 | A1 | | 4/2004 | Telleen | |
| 2004/0094609 | A1 | * | 5/2004 | Mori | 229/80 |
| 2004/0134977 | A1 | * | 7/2004 | O'Dwyer et al. | 229/80 |
| 2004/0166276 | A1 | * | 8/2004 | De La Motte-Bouloumie et al. | 428/40.2 |
| 2005/0045707 | A1 | * | 3/2005 | Stude | 229/308 |
| 2005/0061866 | A1 | | 3/2005 | Ackley et al. | |
| 2007/0023492 | A1 | * | 2/2007 | Stude | 229/308 |
| 2007/0262580 | A1 | * | 11/2007 | Wronski et al. | 283/116 |

FOREIGN PATENT DOCUMENTS

| | | |
|---|---|---|
| JP | 2004-155491 | 6/2004 |
| WO | 99/35551 | 7/1999 |
| WO | 02/079943 | 10/2002 |

OTHER PUBLICATIONS

OPEX Corporation, Envelope Specifications for Automated Extraction (Jul. 31, 1995).

Pastorus, Dan, "Choosing an 'Alternate' Solution," Target Marketing, pp. 84, 87, 89 (Mar. 2001).

Friesen, Pat, "The Power of Inserts," Target Marketing, p. 38 (Feb. 2003).

Roel, Raymond, "Mail Order Alternatives—Package Insert Primer: Part II," Direct Marketing, pp. 60, 94 (Feb. 1988).

Turner, Jim, "Leave Room for a 'Bonus' Insert," ABA Bank Marketing, p. 43 (Oct. 2003).

Hans, Jennifer, "Promotional Items Can Dress Up Business Forms Products," Business Forms, Labels & Systems, pp. 46, 48, 50 (Feb. 2004).

Alonso, Marie, "Opening an Envelope," Printing Impressions, p. 36, 38 (Oct. 2003).

Vidal, Jill Eastman, "Outsource Solutions: Inserts Media—The ABCs of Creating a Package Insert Program," Target Marketing, p. 17 (Apr. 2004).

Lester, Lisa Yorgey, "Direct Mail Metamorphosis—A Checklist for Adapting Your U.S. Package for Overseas Markets," Target Marketing, pp. 40, 43 (Jan. 2003).

Friesen, Pat, "There's More Than One Way to Say 'Thanks'," Target Marketing, pp. 34, 36 (Apr. 2002).

Web Site Article entitled "Assembling Invitation," published by NYCity Weddings.com (Jun. 25, 2004).

Web Site entitled "Envelope Anatomy," published by eagleprint.com (Dec. 9, 2003).

* cited by examiner

INSERT AND ENVELOPE ASSEMBLY

This application claims priority to U.S. Provisional Application Ser. No. 60/660,643, filed on Mar. 11, 2005, the entire contents of which are hereby incorporated herein by reference.

This application is directed to an insert and envelope assembly, and more particularly, to an insert and envelope assembly wherein the insert and envelope are coupled together in various manners.

BACKGROUND

Return envelopes are often packaged with an invoice or the like inside a larger, outer mailing envelope. The outer mailing envelope is then sent to a customer or recipient. For example, the outer mailing envelope may be sent from a retailer to a customer or recipient, and the outer mailing envelope may include an invoice and a return envelope for remitting payment to the retailer.

Various other inserts, such as coupons, advertisements, order forms, promotional materials and can also be located inside the outer mailing envelope. Such inserts may be desired to attract the attention of the recipient (in the case of advertising) and/or may be intended to be returned by the recipient using the associated return envelope. Thus, it may be desired to require or urge the customer to handle or manipulate the insert.

In addition, the mailer or distributor of the inserts and return envelopes may receive large numbers of return envelopes sent by the customers. The distributor or its contractors may use automated extraction or processing machines to process and handle the large number of return envelopes. However, such automated extraction machines may have difficulty processing unconventional envelopes or envelopes sealed in unconventional manners.

Accordingly there is a need for an envelope and insert assembly that requires the recipient to handle or examine the insert prior to returning the envelope. There is also a need for an envelope and insert assembly that helps to ensure the envelope is sealed in a conventional manner.

SUMMARY

In one embodiment the invention is an envelope and insert assembly that requires or urges the recipient to handle or examine the insert prior to returning the envelope. The envelope and insert assembly may also be configured to help ensure that the envelope is sealed in a conventional manner such that it can be easily processed.

In particular, in one embodiment the invention is an insert and envelope assembly including a first envelope having a flap portion and a body portion having an inner cavity. The flap portion is directly attachable to the body portion to generally seal the inner cavity. The assembly further includes an insert located externally of the inner cavity and coupled to the first envelope. The insert is positioned to at least partially block access the inner cavity, and the insert is located and positioned such the insert must be handled or moved in order to fully access the inner cavity. The assembly further includes a second envelope receiving therein the first envelope along with the located and positioned insert.

DETAILED DESCRIPTION

Figure 1:
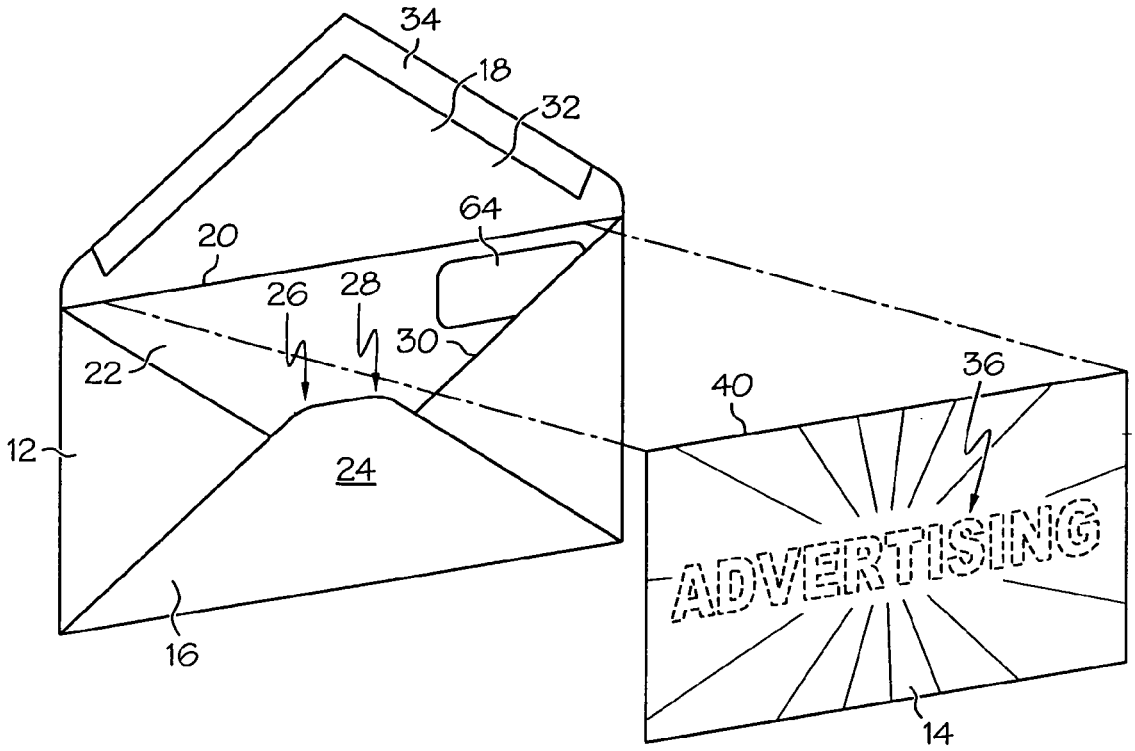
FIG. 1 is a rear view of one embodiment of the insert and envelope assembly of the present invention, with the insert and envelope being spaced apart from each other.

As shown in FIG. 1, in one embodiment the invention is an insert and envelope assembly 10 including an envelope 12 and an insert 14. The envelope 12 may be any variety of envelopes of various shapes or sizes including legal, baronial, announcement, remittance, business, inter-office and the like. The envelope 12 may be of any of a variety of styles of envelopes including, but not limited to, diagonal seam, center seam, side seam, or single side seam-style constructed envelopes. In the illustrated embodiment the envelope 12 is a diagonal seam envelope. A diagonal seam envelope does not include any side seams which can serve to trap components in the envelope.

The envelope 12 can be made of a variety of materials, such as paper (including cellulose-based and/or pulp-based paper) paperboard, plastic, cardboard or the like. The envelope 12 includes a body portion 16 and a flap portion 18 pivotally coupled to the body portion 16 along a fold line 20. The envelope 12/body portion 16 includes a front panel 22 and a rear panel 24 that define a cavity 26 therebetween, the cavity 26 having a mouth 28. The flap portion 18 is pivotable about the fold line 20 between a closed position, wherein the flap portion 18 covers the mouth 28 to generally seal the cavity 26, and an open position, wherein the flap portion 18 does not cover the mouth 28 and does not generally seal the cavity 26.

The rear panel 24 includes a free edge 30 along its upper end thereof. The mouth 28 of the cavity 26 may be positioned between the fold line 20 and the free edge 30. Alternately, the mouth 28 can be defined along or about the free edge 30 and the portions of the front panel 22 opposite the free edge 30.

The flap portion 18 may be sized such that when the flap portion 18 is in its closed position at least part of the flap portion 18 lies on top of, and/or overlaps the rear panel 24. When the flap portion 18 is closed, the cavity 26 is bounded by the inner surface of the front panel 22, the inner surface of the rear panel 24 and part of the underside 32 of the flap portion 18. The underside 32 of the flap portion 18 may include an adhesive 34 (such as a moisture activated adhesive or a pressure sensitive adhesive) or other securing means located thereon and positioned to secure the flap portion 18 to the rear panel 24. The adhesive 34 could be located at locations other than the underside 32 of the flap portion 18, for example, on the outer surface of the rear panel 24 (i.e. adjacent to the free edge 30), or on the inner surface of the front panel 22 (i.e., adjacent to the free edge 30).

The insert 14 may be made of any of a variety of materials, including sheets of thin or flexible material, such as paper, glossy paper, paperboard, plastic, cardboard and the like, and may be smaller in length and/or width than the body portion 16 of the envelope 12. The insert 14 could be a single or multi-panel sheet (i.e. the insert 14 can include one or more fold lines). However, the insert 14 is not limited to these specific characteristics and can take the form of nearly any component that is or can be inserted into or used with the envelope 12. In the illustrated embodiment the insert 14 has a substantially rectangular shape, although the insert 14 can have any of a variety of shapes. The insert 14 can have various indicia 36 printed thereon. The indicia 36 can take any of a variety of forms, such as text, images, drawings, photographs, notices (i.e., a change in an account agreement), or the like. In the illustrated embodiment the indicia 36 takes the form of advertising materials.

Because the envelope 12 and insert 14 may be separate and discreet pieces of material, the envelope 12 and insert 14 may be formed from different materials. For example, the envelope 12 may be made of regular paper stock, which is relatively inexpensive, and the insert 14 may be made of coated stock so that finer details of the indicia 36 can be better illustrated.

Figure 2:
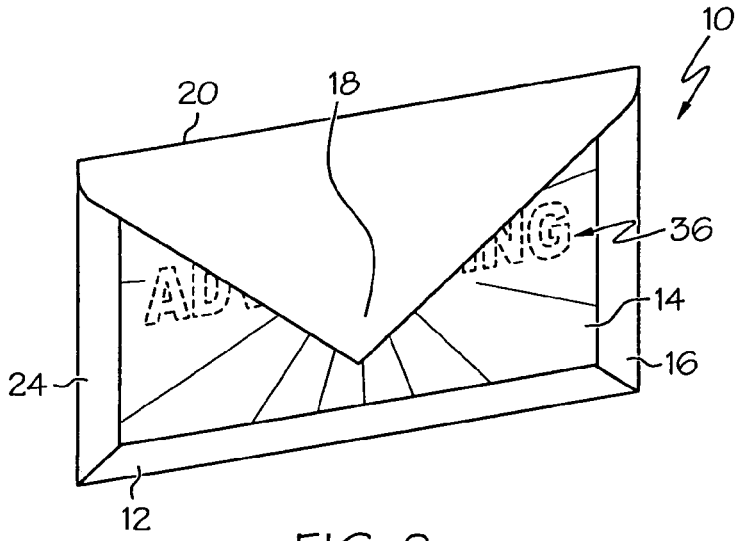
FIG. 2 is a rear view of the envelope and insert assembly of FIG. 1, with the insert and envelope being coupled together.

As shown in FIGS. 1 and 2, in one embodiment the insert 14 is positioned between the flap portion 18 and the body portion 16 of the envelope 12 and located such that an upper edge 40 of the insert 14 is located adjacent to the fold line 20. When the flap 18 is closed, the insert 14 is loosely coupled to the envelope 12 and may be held in place solely by frictional forces. The insert 14 may be positioned adjacent to a majority (by surface area) of the adhesive 34. In other words, the insert 14 may be positioned to cover a majority (i.e., at least about 50%) of the adhesive 34 with respect to the body portion 16.

Figure 3:
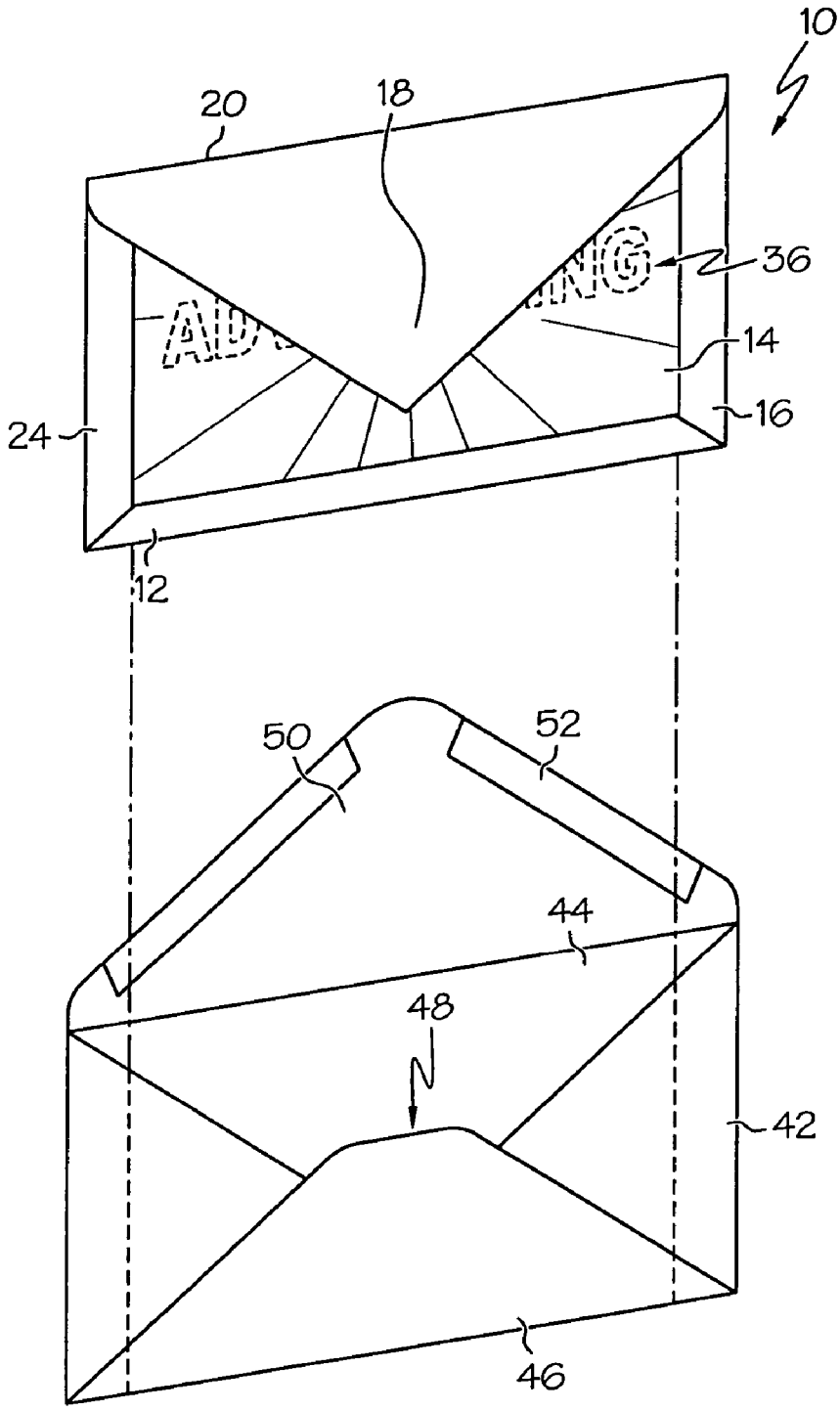
FIG. 3 is a rear view of the envelope and insert assembly of FIG. 2, with the assembly positioned above an outer envelope.

As shown in FIG. 3, the envelope/insert assembly 10 may be inserted into an outer mailing envelope 42. Similar to the envelope 12, the outer mailing envelope 42 may include a front panel 44 and a rear panel 46 that define a cavity 48 therebetween. The outer mailing envelope 42 may have a flap 50 that can be secured to the rear panel 46 by an adhesive 52 to generally seal the cavity 48/envelope 42. However, the outer mailing envelope 42 can take any of a variety of shapes and forms, including the various shapes and forms outlined above for the envelope 12. The outer mailing envelope 42 may be slightly larger than the envelope 12 and sized to closely receive the envelope 12 therein.

Figure 4:
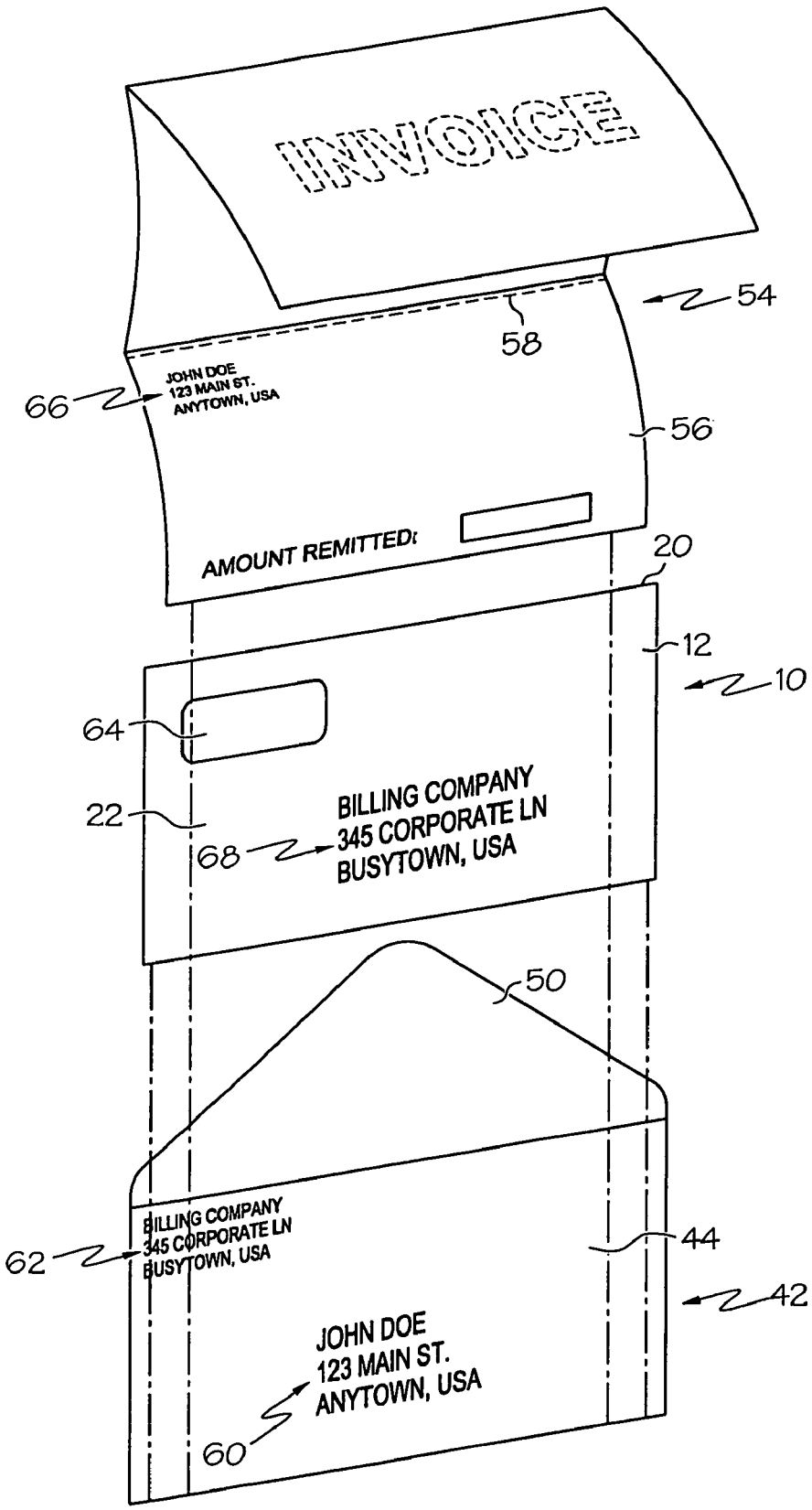
FIG. 4 is a front view of the envelope and insert assembly and outer envelope of FIG. 3, shown with an invoice.

If desired, various other components besides the envelope 12 and insert 14 can also be inserted into the outer envelope 42. For example, as shown in FIG. 4, an invoice 54 may also inserted into the outer envelope 42. The invoice 54 may include billing information that is desired to be sent to a customer or recipient. The invoice 54 may include, for example, an account number, billing information, information relating to an outstanding amount to be paid, address information, etc. The invoice 54 may be a relatively large sheet of paper that needs to be folded to fit into the outer envelope 42.

The invoice 54 may include a return portion 56 along an outer edge thereof that is defined by a tear guideline 58, such as a perforation line. If desired, the return portion 56 may include information, such as the customer name and address, the billing company name and address, account number, billing information, etc. The return portion 56 may be sized to fit into the envelope 12, such as in an unfolded state. In this manner, when the user receives an invoice 54, the user can tear along the tear guideline 58 to separate the return portion 56, and insert the return portion 56 into the envelope 12.

Once the envelope/insert assembly 10 (and invoice 54, if utilized) are inserted into the outer mailing envelope 42, the outer mailing envelope 42 may then be sealed and printed with addressee information 60 (i.e. the address of the customer or recipient) and addressor information 62 (i.e. the address of the billing company, mailer or distributor). Alternately, the outer mailing envelope 42 may be printed with addressee 60/addressor 62 information prior to receiving the envelope/insert assembly 10 (and any other components) therein.

The envelope 12 may be printed with addressee/addressor information. For example, as shown in FIG. 4 the addressor information 68 (i.e., the address of the billing company, mailer or distributor) is pre-printed on the envelope 12. The envelope 12 may also or instead include windows at the addressee and/or addressor locations such that components having an address printed thereon can be received in the envelope 12 and the address information can be viewed through the associated window. For example, in the embodiment shown in FIG. 4 the envelope 12 includes a window or cut-out 64 at the addressee location. If desired a piece of clear, transparent or translucent material may be located in the window 64 in a well-known manner. The return portion 56 of the invoice 54 includes the customer's or recipient's address information 66 printed thereon at the upper left-hand corner. In this manner when the return portion 56 is properly placed in the envelope 12, the customer's or recipient's address is viewable through the window 64 and can be used as the addressee information by the post office or other delivery service.

If desired, the addressee information (i.e. customer or recipient address) can be pre-printed on the envelope 12 (not shown) in place of the window 64. In addition, if desired, a window (not shown) can instead be located at the addressor location 68 of the envelope 12, and addressor information can be printed on the return portion 56 (or other component) and positioned so as to be viewable through the addressor window when the return portion 56 is properly inserted into the envelope 12. In addition, if desired addressee and/or addressor information can be printed on the insert 14, or on some other component sent in/packaged in the outer mailing envelope 12.

In addition, rather than having pre-printed information at the addressee 60/addressor 62 locations, the outer mailing envelope 42 may include one or more windows or cut-outs (not shown) formed therein. A piece of material may be located inside the outer mailing envelope 42 (such as the envelope 12, insert 14 and/or invoice 54) and may include addressee and/or addressor information that is viewable through one or more windows on the outer mailing envelope 42.

Once the customer/recipient receives the outer envelope 4, the outer envelope 42 is opened, and its contents extracted. The envelope/insert assembly 10 should remain in its configuration shown in FIG. 2 due to frictional forces. The customer/recipient may then desire to utilize the envelope 12, i.e. by inserting a component, such as the return portion 56 of an invoice 54, into the inner cavity 26.

As noted above, in the embodiment shown in FIGS. 1-3, the insert 14 is positioned between the flap portion 18 and the body portion 16 of the envelope 12, and covers all or a majority (i.e., at least about 50%) of the adhesive 34 of the envelope 12 with respect to the body portion 16. Because the majority of the adhesive 34 cannot contact the body portion 16 when the insert 14 is positioned as shown in FIGS. 2 and 3, the customer/recipient is encouraged to move/remove, and therefore handle, the insert 14 prior to using/sealing the envelope 12.

For example, if the adhesive 34 is located on the underside 32 of the flap portion 18 (as shown in FIG. 1), the customer/recipient may not be able to effectively secure the flap portion 18 to the body portion 16. Similarly, if the adhesive 34 is located on the body portion 16 of the envelope 12, the insert 14 generally prevents the body portion 16 from being adhered to the flap portion 18 of the envelope 12. In addition, the insert 14 may be required to be moved in order to fully access the inner cavity 26.

Consequently, in order to effectively seal the envelope 12, the insert 14 must be removed from its position between the flap portion 18 and the body portion 16. Forcing or encouraging the customer/recipient to handle the insert 14 ensures that additional attention is paid to the insert 14. This helps to ensure that important notices are recognized by the customer/recipient, and may increase the effectiveness of advertising.

In addition, if the insert 14 is removed by the customer/recipient, this ensures that when the envelope 12 is sent back to the original sender (i.e. the billing company, mailer or distributor) the insert 14 is not coupled to or located on an outer surface of the envelope 12. This helps to ensure more efficient processing. In particular, when automated equipment is used by the billing company, mailer or distributor to open and process the received envelopes 12, any inserts or other components that are coupled to the outer surface of the envelope 12 can interfere with the operation of the automated equipment by causing jams, outsorts, addition processing or the like. If the customer/recipient removes the insert 14, and either discards the insert 14 or places the insert 14 inside the envelope 12, jams of the automated equipment are reduced and more efficient opening and processing operations are provided. In addition, when the envelope 12 is a diagonal seam envelope, the envelope 12 lacks side seams which can trap an insert in the envelope 12 and interfere with automated extraction of the contents of the envelope 12. Thus the use of diagonal seam envelope helps to further ensure smooth processing. When the insert 14 is loosely held under the flap portion 18, the insert 14 can be easily removed and handled.

Figure 5:
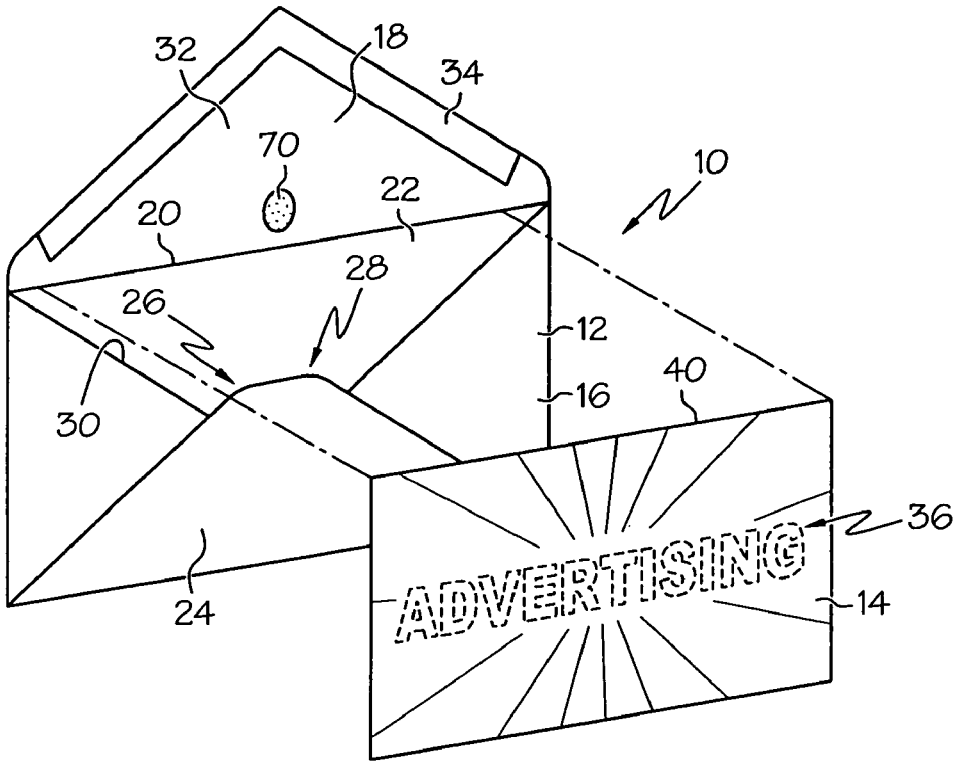
FIG. 5 is a rear view of an alternate envelope and insert assembly of the present invention.

In an alternate embodiment, the insert 14 may be adhered or attached to the envelope 12 to ensure it is properly positioned when removed from the outer mailing envelope 42. For example, as shown in FIG. 5, an insert adhesive 70 may be applied on the underside 32 of the flap portion 18. Thus, when the flap portion 18 is moved to its closed position the insert adhesive 70 contacts the insert 14 and the insert 14 is secured to the flap portion 18 and held in position.

When the insert 14 is adhered to the underside 32 of the flap portion 18 in this manner and the flap portion 18 is closed, the customer/recipient is unable to effectively seal the envelope 12 without handling and/or removing the insert 14. In particular, as outlined above, when the insert 14 is coupled to the flap portion 18 by adhesive 70, the insert 14 may cover substantially all or the majority of the adhesive 34. Consequently, it is difficult for the customer/recipient to access the adhesive 34 without removing the insert 14. In addition, if the customer/recipient activates the adhesive 34 without removing the insert 14, the flap portion 18 will adhere primarily to the insert 14, in which case the envelope 12 would remain substantially unsealed. Finally, when the insert 14 is coupled to the flap 18 and the flap 18 is closed, the insert 14 blocks access to the inner cavity 26. Thus the customer/recipient is guided to handle and remove the insert 14.

The insert adhesive 70 can take a variety of forms such as one or more patterns or strips of adhesive to secure the insert 14 to the envelope 12. The insert adhesive 70 may be, for example, a peelable, pressure sensitive adhesive, a gelatinous adhesive, double-sided tape or the like. The adhesive material 70 may be of a relatively low strength such that the insert 14 can be manually separated from the envelope 12 without causing any tearing or separation of the insert 14 or envelope 12. For example, the adhesive 70 may be a quick release adhesive, easy release adhesive, peelable adhesive, no-damage release adhesive, non-absorbing or non-aggressive adhesive, such as a rubber-based adhesive that can be easily removed from the envelope 12, and from any inserts adhered thereto, without causing damage to the envelope or inserts. The use of a non-absorbing or non-smearing adhesive may be useful to ensure that the adhesive 70 does not soak into, or distort, any text, indicia or drawings on the insert 14 or envelope 12. However, if desired the adhesive 70 can also be of an aggressive/absorbing nature.

The adhesive 70 shown in FIG. 5 is in the form of a dot. However, the adhesive 70 can take any of a variety of configurations, such as a row of dots, a continuous or intermittent line of adhesive, etc. The adhesive 70 can be clear, transparent, translucent, opaque or colored.

Figure 6:
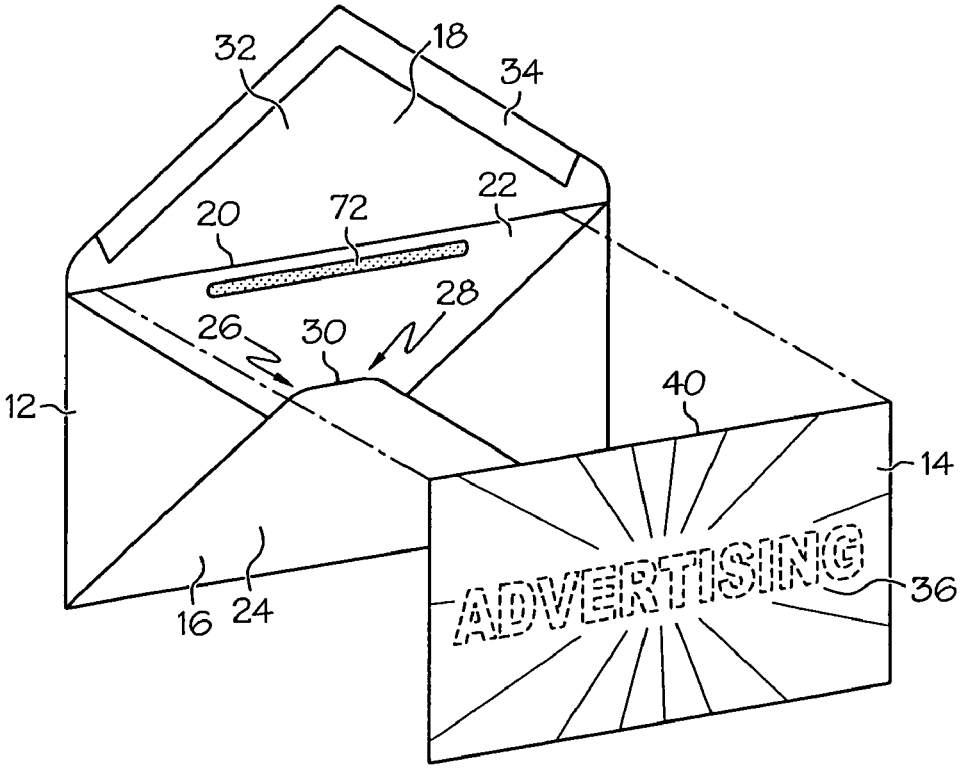
FIG. 6 is a rear view of another envelope and insert assembly of the present invention.

In another embodiment, as shown in FIG. 6, the insert 14 is adhered to body portion 16 of the envelope 12 by an insert adhesive 72 positioned on the inner surface of the front panel 22 of the envelope 12. In this case, the insert adhesive may be positioned between the fold line 20 of the front panel 22 and the upper edge 30 of the rear panel 24. When the insert 14 is coupled to the insert adhesive 72, the insert 14 is again positioned to prevent the adhesive 34 from fully sealing the flap portion 18 to the body portion 16 of the envelope 12. In addition, the customer/recipient is generally prevented, or at least hindered, from accessing the inner cavity 26 of the envelope 12 while the insert 14 is in place. Therefore, the customer/recipient will be guided to handle or move the insert 14 prior to accessing the cavity 26 of the envelope 12 and utilizing the envelope 12. If the insert adhesive 72 is applied to the front panel 22 and the front panel 22 of the envelope 10 is not exposed (i.e., if the free edge 30 is generally aligned with the fold line 20), a notch (not shown) may be cut in the free edge 30 of the envelope 12 to expose a portion of the front panel 22 and allow application of the insert adhesive 72.

The adhesive 72 of FIG. 6 can take the form of the adhesives 70 outlines above. In addition, for illustrative purposes the adhesive 72 shown in FIG. 6 is in the form of a line, although the adhesive 72 can take any of a variety of configurations, such as a dot, a row of dots, an intermittent line of adhesive, etc.

Figure 7:
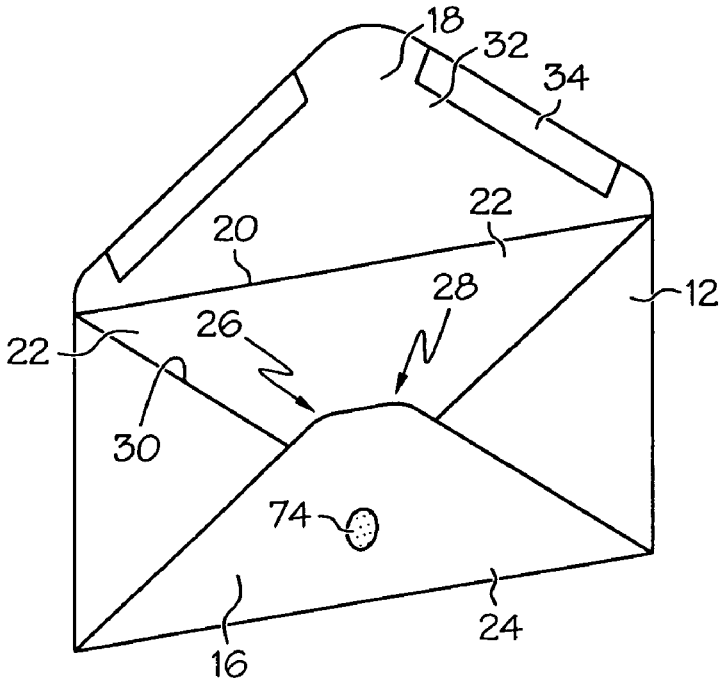
FIG. 7 is a rear view of an alternate envelope.
Figure 8:
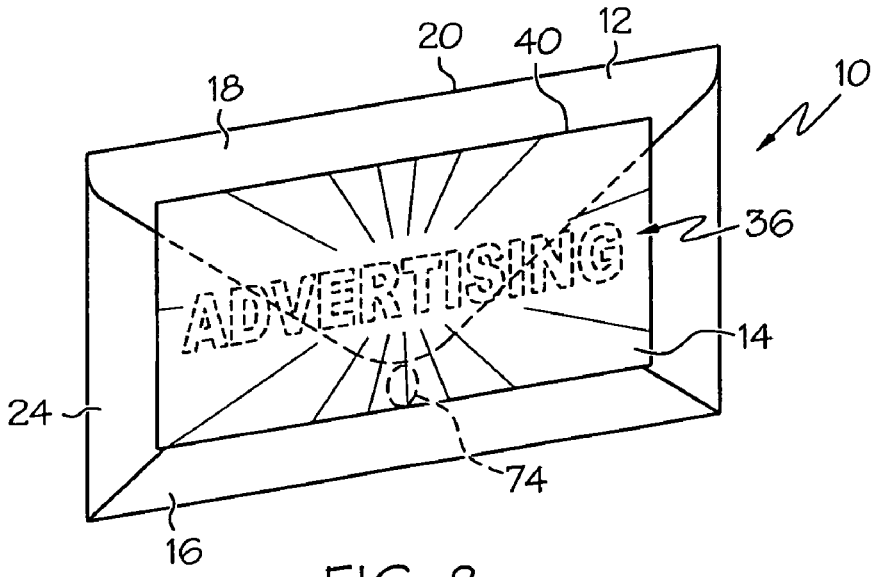
FIG. 8 is a rear view of the envelope of FIG. 7, with an insert coupled thereto.

In another embodiment, as shown in FIGS. 7 and 8, an insert adhesive 74 is located on the rear panel 24 adjacent to the flap portion 18 (when the envelope 12 is closed) and/or adjacent to the free edge 30. The insert adhesive 74 should be positioned to remain uncovered by the flap portion 18 when the flap portion 18 is closed. In this case, the flap portion 18 may be folded into position over the rear panel 24, and the insert 14 may be adhered to the insert adhesive 74 such that the insert 14 covers at least a part, or at least 50%, of the flap portion 18 (see FIG. 8). The envelope/insert assembly 10 in this embodiment encourages a customer/recipient to handle or move the insert 14 prior to opening the flap portion 18 in order to access the inner cavity 26. The adhesive 74 can take the form and shape of the adhesives 70, 72 described above.

As previously noted, once the envelope/insert assembly 10 (i.e., any of the embodiments described above) is formed, the envelope/insert assembly 10 can be inserted into the outer mailing envelope 42 and sent to a customer/recipient. In the embodiment of FIGS. 1-6, the insert 14 is positioned between the flap portion 18 and the body portion 16 of the envelope 12. In the embodiment of FIGS. 7 and 8, the insert 14 is not positioned between the flap portion 18 and the body portion 16. Instead, the insert 14 is located outside of the flap portion 18 and directly or immediately positioned between the flap portion 18 and the front 44 or rear 46 panel of the outer envelope 42. By being "directly" or "immediately" positioned between the flap portion 18 of the envelope 12 and the front 44 or rear 46 panel of the outer envelope 42 it is meant that the body portion 16 of the envelope 12 is not positioned between the flap portion 18 and the associated adjacent front 44/rear panel 46 of the outer envelope 12. In addition, the insert 20 may not be directly attached to the free edge 30 of the envelope 10, and may not be pivotally attached to the free edge 30.

In one embodiment, a method of manufacture of the insert envelope assembly 10, as shown in FIG. 1, includes providing an envelope 12. The envelope 12 may be positioned with the flap portion 18 unfolded such that the underside 32 of the flap portion 18 is exposed. The insert 14 may be placed on the body portion 16 of the envelope 12. The flap portion 18 may be folded such that the insert 14 is positioned between the body portion 16 and the flap portion 18, and adjacent to fold line 20. If an insert adhesive is utilized, the insert 14 is adhered to the insert adhesive. The envelope/insert combination 10 may then be inserted into an outer mailing envelope 42 (FIG. 3) and sent to a customer/recipient. Other enclosures, such as an invoice 54, notice, text, order forms, or the like may be included in the outer envelope 42. At least one of the insert 14, envelopes 12 or 42 or other enclosures may include return address information of the original sender (i.e., the billing company, mailer or distributor).

The present invention provides several advantages over a convention bang-tail envelope (i.e. an envelope with a flap attached to the upper rear edge of the envelope along a perforation line). The use of a convention envelope 12 and an easily formed insert 14 allow for simple formation and assembly as compared to a bangtail envelope which must be specifically manufactured. The present invention also encourages a user to handle and remove the insert 14, which ensures additional attention is paid to the insert 14, and ensures that the insert 14 does not interfere with sealing of the envelope 12. In contrast, in a conventional bang-tail envelope a user may seal the envelope with the flap in place, which means lesser attention may have been paid to the flap, and interferes with sealing of the envelope and opening/automated processes of the bang-tail envelope. Finally the present invention allows the insert 14 and envelop 12 to be made of different materials, whereas in conventional bang-tail envelopes the flap and envelope are made of the same materials.

While particular embodiments of the present invention have been illustrated and described herein, it should be apparent to those skilled in the art that various additional changes and modifications can be made without departing from the spirit and scope of the present invention. It is therefore intended that all such changes and modifications that are within the scope of this invention.

What is claimed is:

1. An insert and envelope assembly comprising:

a first envelope including a flap portion and a body portion having a front panel and a rear panel defining an inner cavity therebetween, wherein said flap portion is directly coupled to said front panel along a fold line and directly attachable to said body portion to generally seal said inner cavity;

an insert located externally of said inner cavity and coupled to said first envelope, said insert being positioned to at least partially block access said inner cavity, wherein said insert is directly removably adhered to said body portion by an insert adhesive positioned on an inner surface of the front panel of said body such said insert must be handled or moved in order to fully access said inner cavity, and said insert and said first envelope are separate and discreet pieces of material; and a second envelope receiving therein said first envelope along with said located and positioned insert.

2. The assembly of claim 1 wherein said second envelope includes a pair of panels defining an inner cavity therebetween, and wherein said insert is positioned between said flap portion and said body portion of said first envelope, or wherein said insert is directly coupled to said first envelope and directly positioned between said flap portion of said first envelope and one of said panels of said second envelope.

3. The assembly of claim 1 wherein said insert is positioned between said flap portion and said body portion of said first envelope.

4. The assembly of claim 3 wherein said flap portion is coupled to said body portion along a fold line, and wherein said insert is positioned such that an upper edge of said insert is located immediately adjacent to said fold line.

5. The assembly of claim 4 wherein said insert is removably adhered to said first envelope in a position such that said upper edge of said insert is located immediately adjacent to said fold line.

6. The assembly of claim 3 wherein said first envelope includes an envelope adhesive that is operable to secure said flap portion directly to said body portion, and wherein said insert is positioned between said flap portion and said body portion such that said insert said covers at least 50% of said envelope adhesive.

7. The assembly of claim 1 wherein said first envelope includes an envelope adhesive that is operable to secure said flap portion directly to said body portion, and wherein said insert is located and positioned to prevent a user from utilizing the majority of said envelope adhesive to secure said flap portion to said body portion.

8. The assembly of claim 7 wherein said first envelope includes an envelope adhesive that is operable to secure said flap portion directly to said body portion and wherein said insert is located and positioned to encourage a user to handle said insert such that after handling said insert said user is able to utilize the majority of said envelope adhesive to secure said flap portion to said body portion and is able to fully access said inner cavity.

9. The assembly of claim 1 wherein said insert is not directly coupled to said upper free edge of said rear panel.

10. The assembly of claim 1 wherein said insert and said first envelope are made of different materials.

11. The assembly of claim 1 wherein said first envelope has address information pre-printed thereon, or has a window positioned at an addressee or addressor location thereof through which address information can be viewed.

12. The assembly of claim 1 further comprising an invoice located in said second envelope, and wherein said invoice includes a return portion at least partially defined by a tear guideline and configured such that said return portion is sized to fit in said first envelope in an unfolded state.

13. The assembly of claim 1 wherein said first envelope includes an envelope adhesive that is operable to secure said flap portion directly to said body portion and wherein said envelope adhesive is positioned on an underside of said flap portion.

14. An insert and envelope assembly comprising:

a first envelope including a flap portion and a body portion having a front panel and a rear panel defining an inner cavity, wherein said flap portion is directly attachable to said body portion to generally seal said inner cavity;

an insert located externally of said cavity and coupled to said first envelope, said insert being positioned to at least partially bock said inner cavity, wherein said insert is located and positioned such said inset must be handled or moved in order to fully access said interior cavity, wherein said insert and said first envelope are separate and discreet pieces of material and wherein said insert is removably adhered to said first envelope by an insert adhesive that is positioned on an inner surface of the front panel of said body portion; and a second envelope receiving therein said first envelope along with said located and positioned insert, wherein said first envelope is a diagonal seam envelope.

15. The assembly of claim 1 wherein said second envelope includes a flap portion, a body portion having an inner cavity and an envelope adhesive which is operable to secure said flap portion of said second envelope directly to said body portion of said second envelope, and wherein said inner cavity of said second envelope is sized to closely receive said first envelope therein in an unfolded state.

16. The assembly of claim 1 wherein said first envelope includes an envelope adhesive which is operable to secure said flap portion directly to said body portion.

17. An insert and envelope assembly comprising:

an envelope including a flap portion, a body portion and securing means which are operable to secure said flap portion directly to said body portion, said body portion having a front panel and a rear panel that define a cavity; and an insert located between said flap portion and said body portion and external to said cavity, said insert being positioned to at least partially prevent said flap portion from being directly secured to said body portion by said securing means, and said insert being positioned to at least partially bock said inner cavity, wherein said insert is removably adhered directly to said envelope by an insert adhesive that is positioned on an inner surface of said front panel of said body portion, wherein said insert and said envelope are separate and discreet pieces of material.

18. The assembly of claim 17 further comprising another envelope receiving said envelope and said located and positioned insert therein.

19. The assembly of claim 17 wherein said insert is directly releasably adhered to said body portion.

20. An insert and envelope assembly comprising:

a first envelope including a flap portion, a body portion having a front panel and a rear panel that define an inner cavity and securing means which are operable to secure said flap portion directly to said body portion to thereby generally seal said inner cavity;

an insert located externally of said inner cavity and positioned between said flap portion and said body portion, wherein said insert is positioned to at least partially prevent said flap portion from being directly secured to said body portion by said securing means, wherein said insert is adhered directly to said envelope body portion by an insert adhesive that is positioned on an inner surface of said front panel; and a second envelope receiving therein said first envelope along with said located and positioned insert.

21. The assembly of claim 17 wherein said flap portion is directly coupled to said front panel along a fold line, and wherein said rear panel has an upper free edge, and wherein said insert is not directly coupled to said upper free edge of said rear panel.

22. The assembly of claim 17 wherein said insert and envelope are both made of paper.

23. The assembly of claim 20 wherein said insert is directly removably adhered to said body portion.

* * * * *